US007159735B2

(12) United States Patent
Morse

(10) Patent No.: US 7,159,735 B2
(45) Date of Patent: Jan. 9, 2007

(54) BUCKET INSERT

(76) Inventor: Robert O. Morse, 328 Broad St., Tonawanda, NY (US) 14150

( * ) Notice: Subject to any disclaimer, the term of this patent is extended or adjusted under 35 U.S.C. 154(b) by 0 days.

(21) Appl. No.: 11/125,881

(22) Filed: May 10, 2005

(65) Prior Publication Data

US 2005/0252919 A1 Nov. 17, 2005

Related U.S. Application Data

(60) Provisional application No. 60/570,372, filed on May 11, 2004.

(51) Int. Cl.
*B65D 1/24* (2006.01)
*B65D 25/04* (2006.01)
*B65D 85/00* (2006.01)

(52) U.S. Cl. ..... 220/529; 220/23.87; 220/737; 206/427

(58) Field of Classification Search ..... 220/23.83, 220/23.86, 23.87, 23.88, 23.89, 510, 512, 220/528, 741, 742, 915.2, DIG. 15, 752, 220/759, 768, 770; 206/139, 203, 372, 373, 206/427, 561, 562, 213; 16/110.1, 422, 425
See application file for complete search history.

(56) References Cited

U.S. PATENT DOCUMENTS

| | | | | |
|---|---|---|---|---|
| 86,422 | A | 2/1869 | Larimore | |
| D168,713 | S | 1/1953 | Rubin | |
| 3,248,002 | A * | 4/1966 | Song | 220/768 |
| D207,191 | S | 3/1967 | Kearns et al. | |
| D216,145 | S | 11/1969 | Swett et al. | |
| D232,341 | S | 8/1974 | Mudde et al. | |
| 3,913,778 | A | 10/1975 | Oglesbee | |
| 3,951,259 | A * | 4/1976 | Oglesbee | 206/164 |
| 4,342,388 | A * | 8/1982 | Torokvei | 206/203 |
| 4,403,483 | A | 9/1983 | Lisalda | |
| 4,901,846 | A | 2/1990 | Lehman | |
| D314,731 | S | 2/1991 | Ryason et al. | |
| 5,035,321 | A | 7/1991 | Denton | |
| 5,271,520 | A | 12/1993 | McAfee | |
| D345,674 | S | 4/1994 | Charland | |
| D376,298 | S | 12/1996 | Rapaz | |
| 5,632,971 | A * | 5/1997 | Yang | 428/34.1 |
| D398,482 | S | 9/1998 | Wang | |
| 5,802,760 | A * | 9/1998 | Campbell | 43/57 |
| D399,394 | S | 10/1998 | Rapaz | |
| 5,836,446 | A * | 11/1998 | Varnom | 206/373 |
| D416,761 | S | 11/1999 | Miller | |
| 6,254,055 | B1 | 7/2001 | Lamberson, Jr. | |
| 6,360,891 | B1 | 3/2002 | Rideout | |

* cited by examiner

*Primary Examiner*—Anthony Stashick
*Assistant Examiner*—Harry A. Grosso
(74) *Attorney, Agent, or Firm*—Hodgson Russ LLP

(57) ABSTRACT

A carrier comprising a bucket insert and bucket wherein the bucket insert comprises a first member having a handle having an opening, connectors, a second member joined or connected to the first member by the connectors, and wherein the first member defines openings for receiving beverage containers, and the second member supports beverage containers. The bucket having an internal stop member so that the bucket insert comes to rest on the stop member when installed in the bucket. A storage space defined by the second member, the base of the bucket, and the surrounding bucket wall. Another embodiment of the insert comprises a blow molded handle, connectors, and first and second members, such that the insert can be snapped together.

10 Claims, 11 Drawing Sheets

BUCKET INSERT

CROSS REFERENCE TO RELATED APPLICATION

This application claims the benefit of U.S. Provisional Application No. 60/570,372, filed May 11, 2004, to Robert O. Morse for a Bucket Insert.

BACKGROUND

People frequently attend sporting events or participate in sports and bring with them their equipment, beverage and water bottles, towels, cell phones, snacks, and other personal items. People often want to bring many personal items with them to such events, but have no practical way to transport such articles from their vehicles to the playing field, rink, arena, or other venue where the games are to be played.

In addition, if personal items are brought they have a tendency to become scattered, lost, misplaced, or mixed up with the personal items belonging to another person or player. Or, all the sporting equipment, beverage containers, and gear ends up in a pile along the sidelines of the playing field. This results in confusion and lost equipment, all of which decreases the enjoyment associated with attending and/or participating in sporting activities.

Therefore, there is a need for a storage unit that can be used to store and transport equipment, beverage containers, personal items/articles and sporting equipment that is lightweight, that can be mass produced at low production cost and that is easy to use.

SUMMARY

In one of the preferred embodiments of the invention, there is a bucket insert provided that is sized such that it can be received in a five (5) gallon type bucket. The bucket insert comprises a first member that has a first diameter and a second member that has a second diameter that is less than the diameter of the first member. In one of the preferred embodiments, four (4) connectors or legs connect the first member and the second member, and nails, fasteners, or friction fit is used to join the connectors to the first and second members. In other embodiments there can be fewer connectors, for example two connectors. The first member has six (6) beverage container openings that are spaced equal distances from one another. The beverage container openings are sized to receive water bottles or beverage containers. The second member has a bottle side that provides support for the beverage containers. An insert handle is joined to the first member. The handle is used for manually inserting and removing the bucket insert from the bucket and the handle has an opening.

The bucket has a base having an interior surface and an exterior surface, and the bucket has a truncated conical-shaped surrounding wall. The truncated conical-shaped surrounding wall has a first end having a first diameter and a second end having a second diameter that is greater than the first diameter. The first end of the surrounding wall is joined to the base. The base has an interior surface and an exterior surface, and the surrounding wall has an interior surface and an exterior surface. An opposed second end of the surrounding wall has a bucket rim. The rim extends between the interior and exterior surfaces of the surrounding wall. In addition, the bucket has a bucket opening opposite the base. A wire handle is pivotally mounted to the exterior surface of the surrounding wall.

Extending from the interior surface of the surrounding wall is at least one stop, and in a preferred embodiment, there are two such stops. Thus, when the bucket insert is lowered into the bucket through the bucket opening, the second member of the insert contacts the stops and is supported by the stops. The stop prevents the insert from moving deeper into the bucket, that is closer to the base of the bucket. Thus, because the insert is supported by the stops, there is advantageously no friction fit between the insert and the bucket. After coming to rest on the stops, the first member is substantially flush with the rim of the bucket, and the second member is spaced a distance from the base of the bucket, for example, from about one (1) inch to about six (6) inches. In other embodiments, the distance can be more or less. Thus, a storage space is defined between the second member, the interior surface of the base and the interior surface of the surrounding wall that extends between the base and second member.

In this storage space personal items and articles, hockey pucks, tennis balls, sporting equipment, towels, first aid kits, and other articles can be advantageously stored. Also, the size and shapes of the openings in the first member may be variously embodied. In one of the preferred embodiments there are six ( ) equally sized openings spaced from one another in the first member and can accommodate water/beverage bottles. In other preferred embodiments the openings in the first member can number fewer or more than six, can each have different diameters, and have differently shaped geometric openings, for example, rectangular, triangular. All of this advantageously allows the insert to accommodate beverage bottles/containers of varying diameters and geometric configuration. As another advantage, the bucket can be carried by its wire handle while the insert is positioned in the bucket. This is possible because when the wire bucket handle is in the upright carrying position, there is a gap space of between about 1.5 inches to about 2.0 inches between the insert handle and wire bucket handle. The gap space advantageously provides for clearance between the knuckles of the person carrying the bucket and the insert handle. The insert may comprise wood, plastic, metals, aluminum, metal alloy, fiberglass, rubber, and combinations thereof.

In other preferred embodiments, there can be more or fewer than four connectors or legs, for example, three or two connects can be used that are equally spaced apart. Or, a centrally located connector can be used to connect the first and second members. Or, more than four connectors can be used.

In yet another preferred embodiment, the first and second members, connecting members, and handle are all blow molded components, to thus provide for a snap together insert. In a preferred embodiment, a high density polyethylene (HDPE) is used. In this embodiment, all of these components are hollow, which advantageously decreases the weight of the bucket insert, and allows for the mass production of the insert at low production cost. Also, the first member is formed with the desired number of openings for receiving beverage containers. The first member in this embodiment is also formed with an integral lip portion, such that when this insert is position in a bucket, the lip contacts the bucket rim and is supported by the bucket rim. This eliminates the need for the above-described stops. In addition, the connecting members are provided with circumferential grooves, and the first and second members are provided with openings having annular ribs. This structure advantageously allows the connectors and first and second members to be snapped together when the annular ribs are moved into the annular grooves. This advantageously allows the first and second members and connecting members to be snapped together, which eliminates the need for nails, fasteners and/or adhesives to assemble the insert. Also, the first member has a handle opening into which the handle can be joined by snapping the two together.

BRIEF DESCRIPTION OF THE FIGURES

At the outset, it is noted that like reference numbers are intended to identify the same structure, portions, or surfaces consistently throughout the figures.

DETAILED DESCRIPTION

Figure 6:
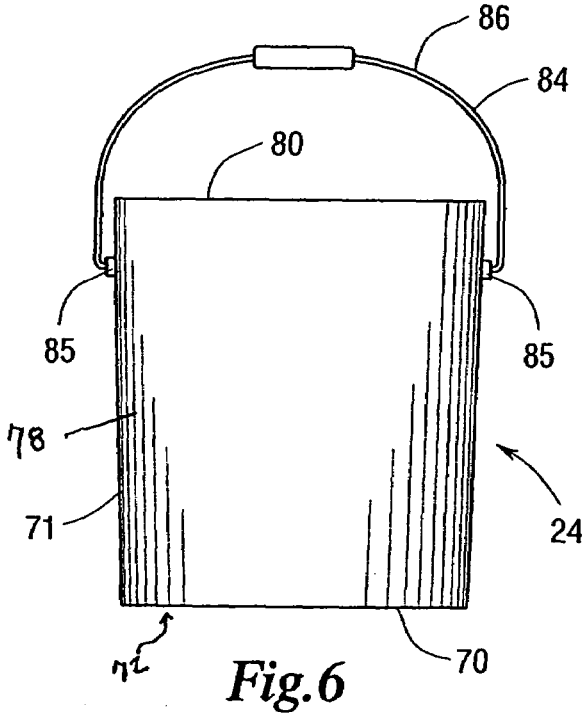
FIG. 6 is a front elevational view of the bucket.
Figure 7:
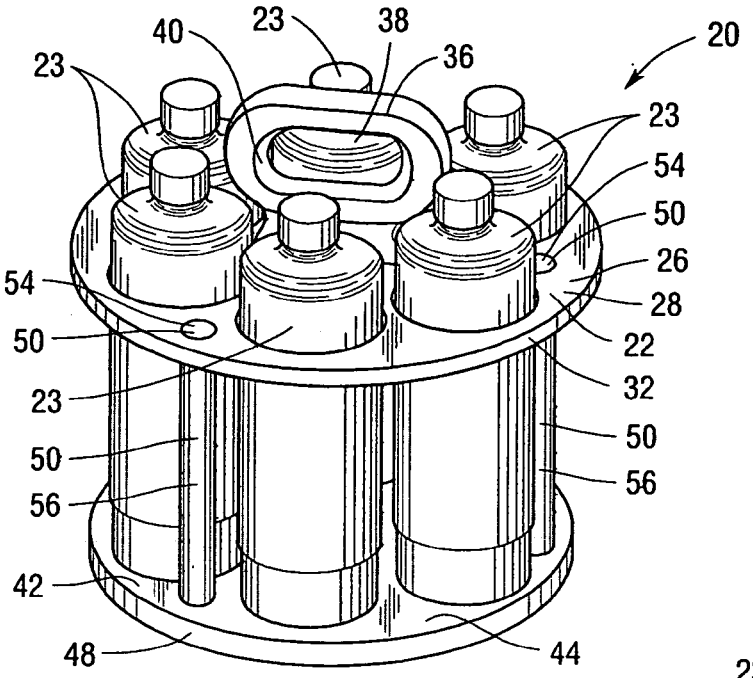
FIG. 7 is a perspective view of the bucket insert loaded with bottles.
Figure 8:
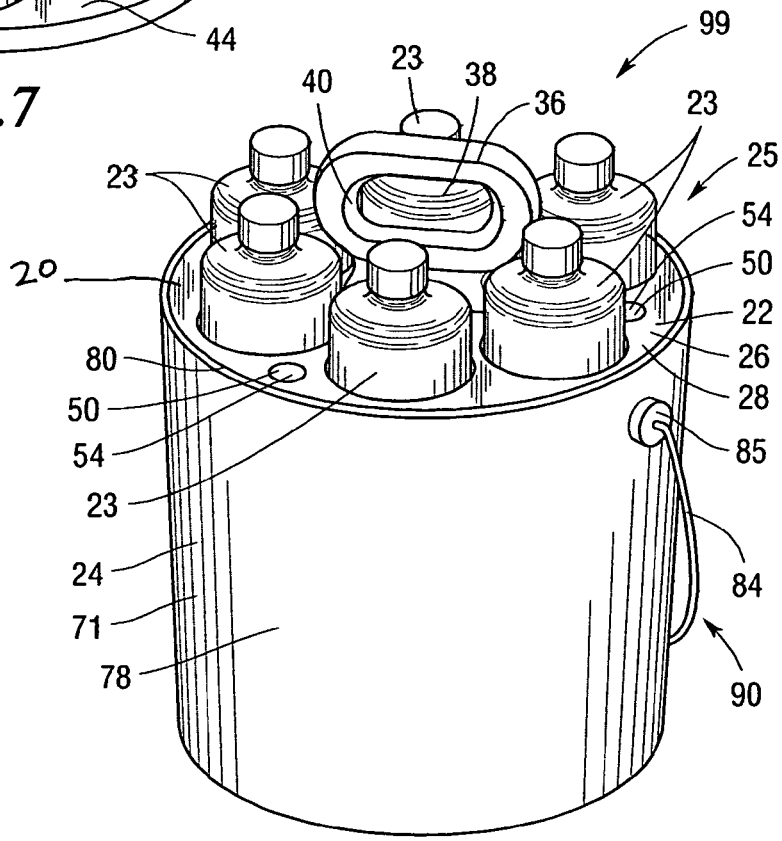
FIG. 8 is a perspective view of the bucket insert loaded with bottles and positioned in the bucket.
Figure 9:
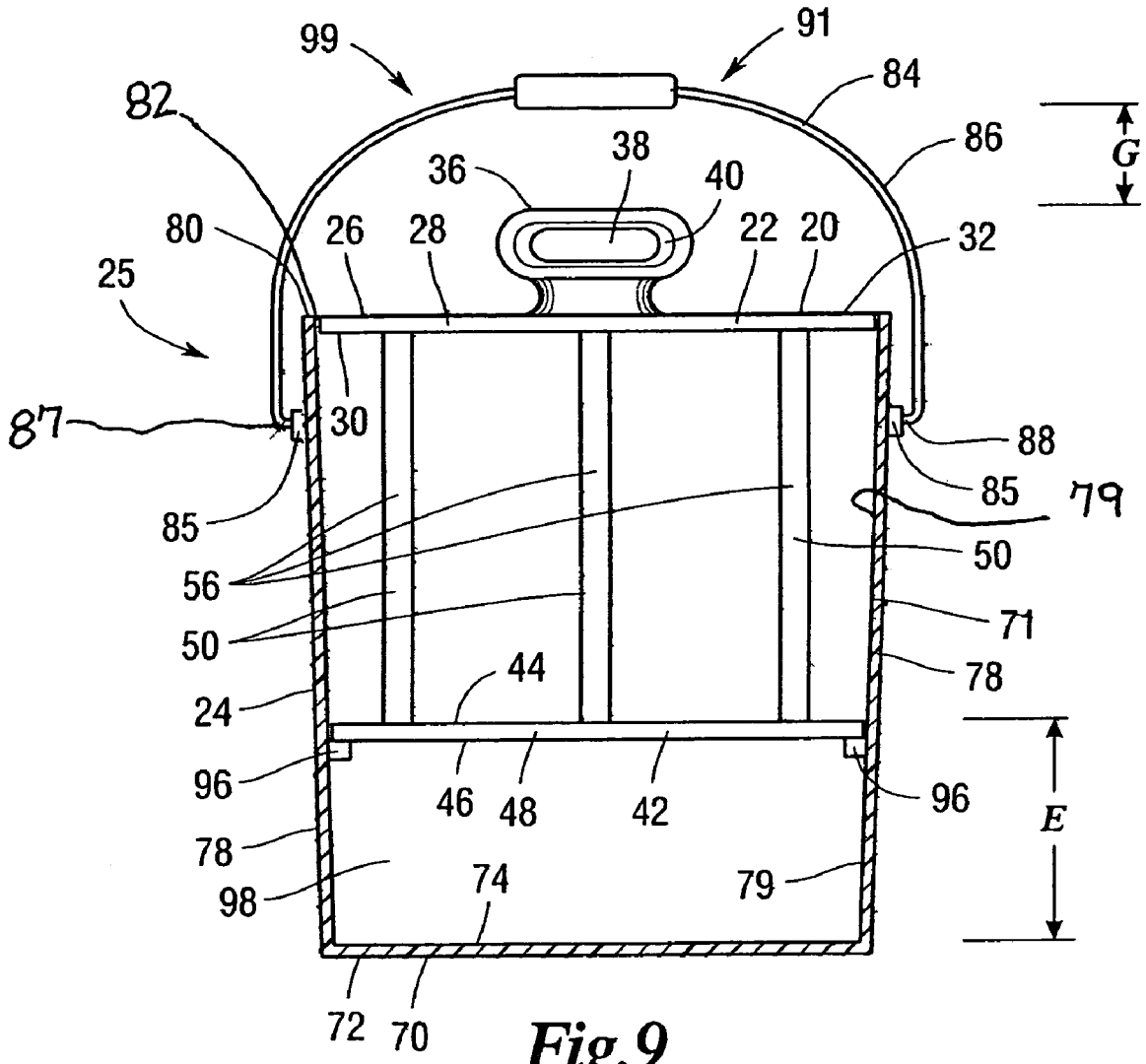
FIG. 9 is a sectional view of the bucket with an insert installed therein.

The bucket insert 20 is shown generally in FIGS. 1–4 and 7–9. The bucket insert 20 (hereinafter insert 20) is a body 22 that can advantageously support a number of beverage containers or bottles 23, as shown in FIG. 7. The insert 20 can advantageously be positioned in a bucket 24, as shown generally in FIGS. 5–6 and 8–9, to thus form a transport 25 comprising the bucket 24 and insert 20, as shown in FIGS. 8 and 9.

Turning now to FIGS. 1–4, the insert 20 comprises a first member 26 having a handle side 28 and an opposed support side 30 with a surrounding surface 32 extending between the opposed handle and support sides 28, 30, respectively. The first member 26 is substantially circular shaped and has a first diameter designated D1 in FIG. 2. The first member 26 has spaced apart bottle receiving openings 34. In one of the preferred embodiments, the bottle receiving openings number six (6) and are spaced equal distances from one another. In other preferred embodiments, the number of bottle receiving openings 34 can be more or less than six, for example one, three, or eight, and the diameters of the bottle receiving openings 34 can be the same or different. In other embodiments, the bottle receiving openings 34 can have a rectangular shape or some other geometry.

Figure 4:
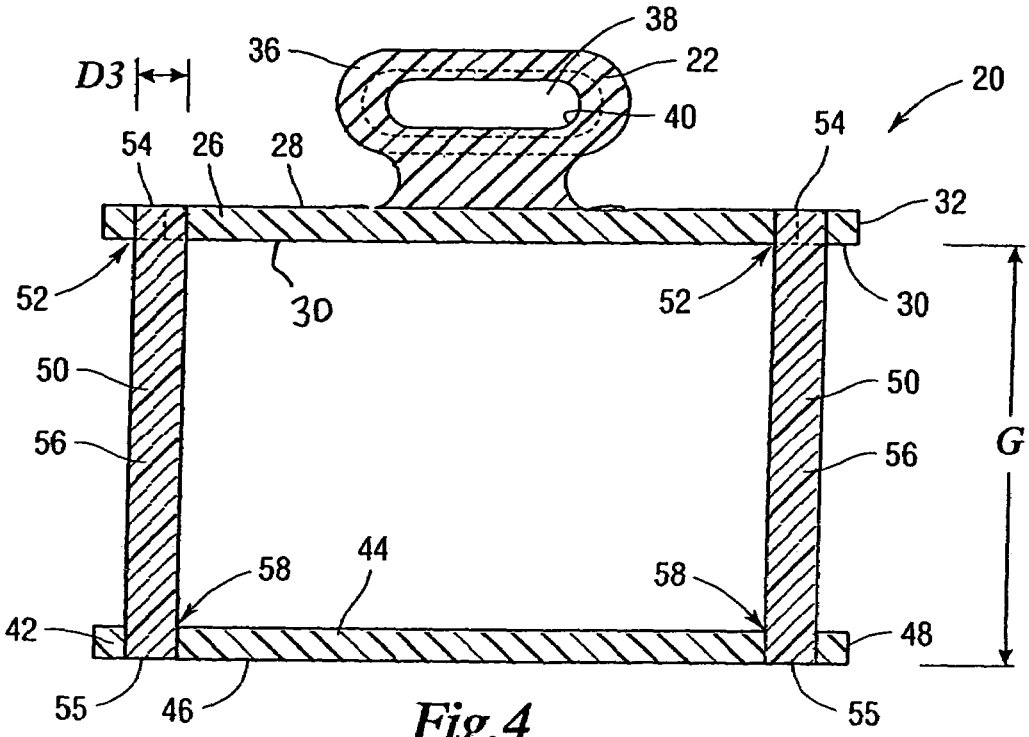
FIG. 4 is a sectional view of the bucket insert taken along cut line I—I of FIG. 2.

As shown in FIG. 4, joined to the handle side 28 is a handle 36 having an elongated opening 38 defined by an elongated opening surface 40. The handle 36 is joined to the handle side 28 with adhesives, fasteners, nails, screws, and the like. The elongated opening 38 is advantageously sized so that a user (not shown) can insert his or her fingers into the elongated opening 38 and readily move the insert 20 into or out of the bucket 24 in a manner to be described presently.

The insert 20 further comprises a second member 42, as shown in FIGS. 1, 3, 4, 7 and 9 that is also substantially circular shaped like the first member 26. The second member 42 has a bottle side 44 and an opposed base side 46. A surrounding surface 48 extends between the bottle side 44 and the base side 46. The bottle side 44 of the second member 42 can, in one of the preferred embodiments, be substantially planar as shown. In addition, the second member 42 has a second diameter designated D2 in FIG. 3. In one of the preferred embodiments, the first diameter designated D1 is greater than the second diameter designated D2, so that the insert 20 can be inserted or received in the bucket 24 having surrounding wall 71 that has a truncated conical shape, as will be described presently in connection with FIGS. 5–6 and 8–9.

Figure 1:
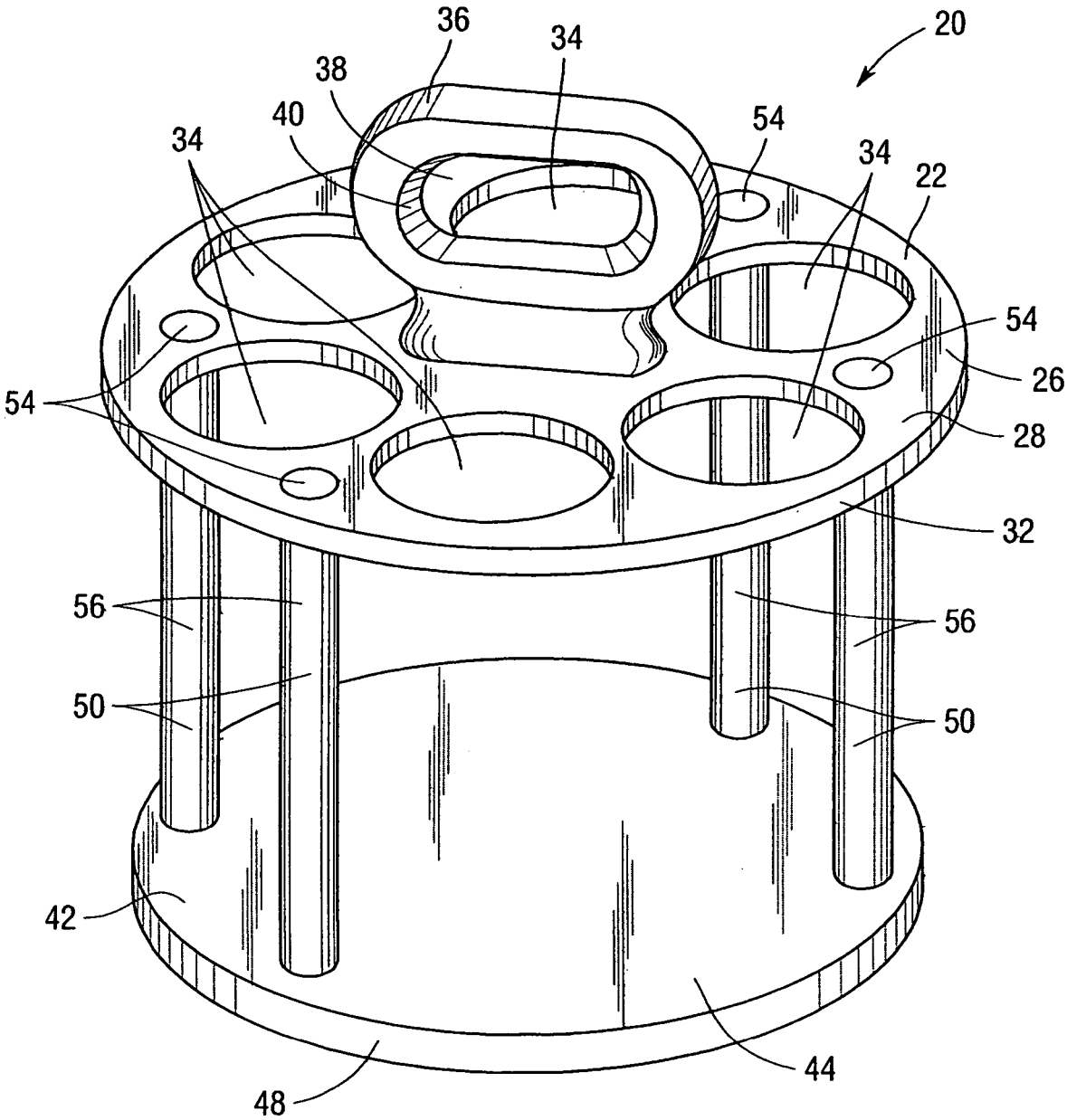
FIG. 1 is a perspective view of the bucket insert.
Figure 2:
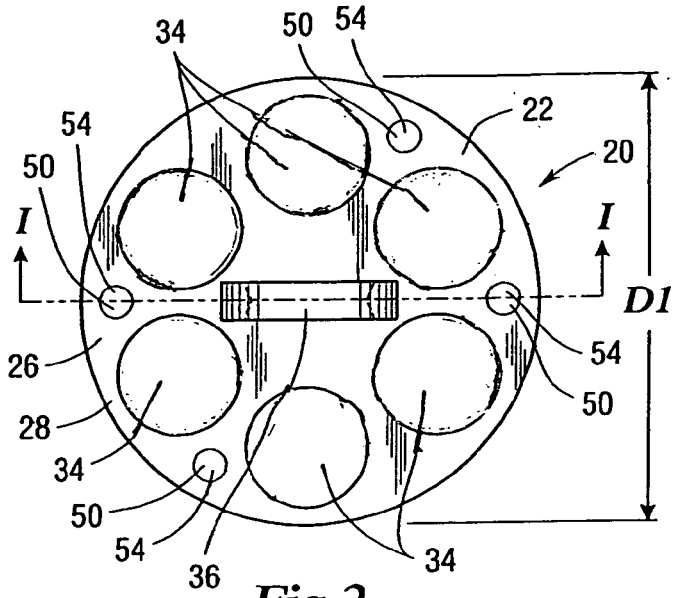
FIG. 2 is a top plan view of the bucket insert.
Figure 2A:
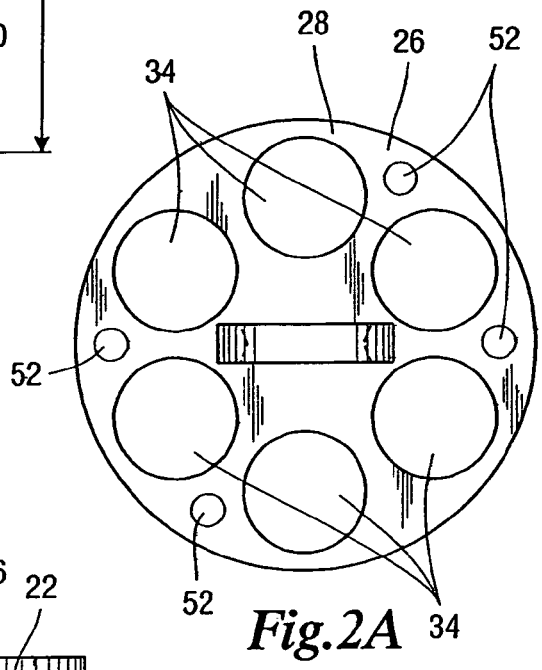
FIG. 2A is a top plan view of the first member of the bucket insert.
Figure 3:
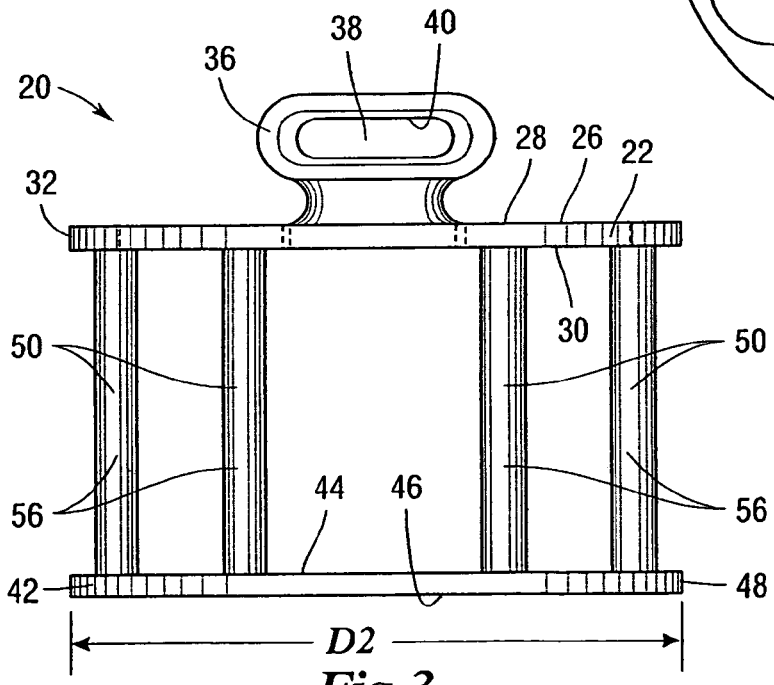
FIG. 3 is a front elevational view of the bucket insert.

The first member 26 is connected to the second member 42 by legs or connectors, commonly designated 50, as shown in FIGS. 1, 3, 4, 7 and 9. Each connector or leg 50 has opposed first and second ends 54, 55, respectively, as shown in FIG. 4, that are separated by a central portion 56 having a generally cylindrical shape and circular cross-section. Each connecting member 50 thus has a leg diameter designated D3 in FIG. 4. As shown in FIG. 2A, connector openings 52 are provided for in the first member 26, and in one of the preferred embodiments, the first member 26 has four (4) connector openings 52. The diameters D3 of the connectors 50 are less than the diameters of the connector openings 52, and as a result the connectors 50 can be moved through the connector openings 52. The second end 55 of each of the four connectors 50 is moved adjacent to the handle side 28 such that they align with the leg openings 52 in the first member 26, and the connectors 50 are moved through the connector openings 52 in the first member 26. The connectors or legs 50 are moved through the connector leg openings 52 until the first ends 54 of the connectors or legs 50 are substantially flush with the handle side 28 of the first member 26, as shown in FIG. 4.

The second member 42 has four connector or leg openings 58, each for receiving one of the above-described legs 50, as shown in FIG. 4. The second ends 55 of the legs 50 are moved into the leg openings 58 in the second member 42, until the second ends 55 of each of the connectors 50 are substantially flush with base side 46 of the second member 42. The legs are then joined to the first and second members 26, 42, respectively, by nailing, fasteners, tacking, adhesives, friction fit and/or other suitable means. Thus, the first and second members 26, 42, respectively, are in a spaced apart relationship, and the distance, designated G in FIG. 4, that they are spaced apart is determined by the length of the central portion 56 of the connectors 50.

As shown in FIGS. 5–6 and 8–9, the bucket 24 comprises a base 70 and a surrounding wall 71 that is joined to the base. Since the bucket comprises plastic in one of the preferred embodiments, the base 70 and surrounding-wall 71 are integrally formed. The base 70 has an exterior side 72 and an interior side 74, and is generally circular shaped. The surrounding wall 71 has an exterior surface 78, an interior surface 79, and a rim 80 that extends between the exterior surface and interior surfaces, 78, 79, respectively. The rim 80 defines the bucket opening 82. In one of the preferred embodiments, the bucket surrounding wall 71 has a generally truncated conical shape wherein it tapers from the rim 80 where it has its greatest diameter, to the base 70 where the diameter is smallest. That is, the maximum internal bucket diameter is at the rim 80, and the internal bucket diameter decreases in a direction toward the base 70, and the minimum internal bucket diameter exists where the surrounding wall 71 is joined to the base 70.

The bucket 24 further comprises a bucket handle 84, as shown in FIGS. 6 and 8–9. In one of the preferred embodiments, the bucket handle 84 comprises an arched or curved wire band 86 that is pivotally mounted to the exterior surface 78 of the surrounding wall 71. For this purpose, opposed handle mounts 85 are connected to or formed integral with the bucket 24, and are for receiving the first and second ends 87, 88, respectively, of the wire band 86, as shown in FIG. 9. The first and second ends 87, 88, of the wire band 86 are installed in the mounts 85 such that the bucket handle 84 is pivotally attached to the mounts 85. This allows for the handle 84 to be movable between a lowered position 90, shown in FIG. 8, and a raised position 91, shown in FIGS. 6 and 9, relative to the base 70. Pivotally attaching a handle to a bucket is well known to those having ordinary skill in the art.

Figure 5:
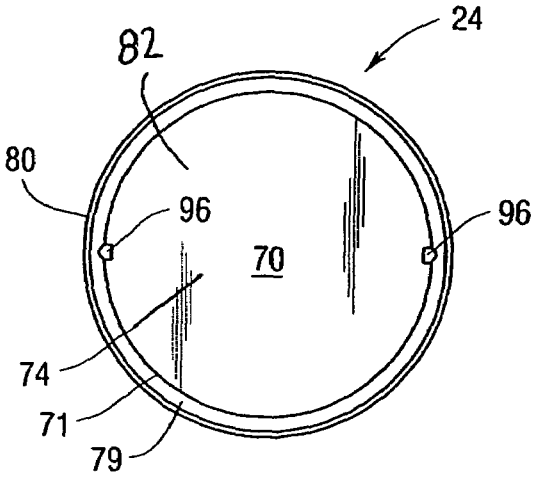
FIG. 5 is a top plan view of the bucket.

Advantageously connected or joined to the interior surface 79 of the surrounding wall 71 of the bucket 24 is a stop 96. In one of the preferred embodiments, there are two stops 96 extending from the interior surface 79 of the bucket 24 one hundred eighty degrees from one another, as shown in FIGS. 5 and 9. The stop 96 is spaced a stop distance, designated E in FIG. 9, from the base 70 of the bucket 24. The stop 96 can be connected to the bucket interior surface 79 with screws, bolts, fasteners (not shown), or the stop 96 can be formed integrally with the bucket 24.

As shown in FIG. 9, when the insert 20 is positioned in the bucket 24, a storage area 98 is thus defined in the bucket 24 as the region bounded by the interior side 74 of the base 70, the base side 46 of the second member 42, and the portion of the surrounding wall 71 interior surface 79 extending between the base 70 and the second member 42.

As shown in FIG. 9, volume of the storage area 98 can be increased or decreased by connecting the stop member 96 to the interior surface 79 of the bucket 24 at different distances from the base 70, to thus vary the height, designated E in FIG. 9 and measured from the interior side of the base 74, of the storage area 98. The length of the connectors 50 can be adjusted accordingly to accommodate differing heights, so that the handle side 28 of the first member 26 remains substantially flush with the rim 80 of the bucket 24. The height designated E can be varied from, for example, about one (1) inch to about six (6) inches. Of course, in other embodiments the height designated E can be less or more.

In addition, as shown in FIG. 9, because the insert 20 is supported on the stops 96, it is advantageously prevented from moving deeper into the bucket 24. This advantageously prevents problematic wedging of the insert 20 in the bucket 24. In addition, the stops 96 advantageously prevent the insert 20 from crushing anything in the storage area 98, for example electronic items, glasses, cell phones, and the like.

The above described bucket insert 20 can comprise wood, plastic, metal, and combinations thereof. The legs 50 can be wood, metal, plastic, or other suitable material, and they can be nailed, bolted, glued, or otherwise connected to the first member 26 and second member 42. The bottle receiving openings 34 in the first member 26 can be drilled or otherwise formed therein. In other embodiments, the bucket insert 20 could comprise lightweight metals, aluminum, fiberglass, and combinations thereof.

A carrier 99 is thus provided for that comprises the above described insert 20 and bucket 24. The carrier 99 is advantageously easy to use. To use the carrier 99, the user manually lifts the insert 20 by its handle 36 and inserts it into the bucket 24 through the bucket opening 82. This movement continues until the base side 46 of the second member 42 contacts the stop member 96, or stop members 96 if the bucket 24 is embodied with more than one stop member 96. The bucket insert 20 is thus advantageously supported by the stop members 96, and as a result, there is no friction fit between the bucket insert 20 and the interior surface 79 of the bucket 24. After insertion into the bucket 24, the handle side 28 of the insert 20 is substantially flush with the rim 80 of the bucket 24, as shown in FIG. 8.

The user (not shown) can move beverage containers 23, shown in FIGS. 7 and 8, through the bottle openings 34. The beverage containers 23 are supported by the bottle side 44 of the second member 42. Thus, the user can advantageously easily load the insert 20 with beverage containers 23 filled with beverage, and then move the insert 20 into the bucket 24. Or, the user can position the insert 20 in the bucket 24 in the above-described manner, and then move beverage containers 23 in and out of the bottle openings 34 as desired. In addition, the storage area 98 can be advantageously easily accessed by lifting the insert 20 out of the bucket 24, and the storage area 98 can be used to store items such as hockey pucks, tennis balls, towels, toys, snacks, glasses, radios, electronic equipment, keys, cell phones, hats, gloves, first aid kits and other personal articles (not shown).

Additionally, as another advantage, the carrier 99 can be carried by the bucket handle 84 while the bucket insert 20 is installed or supported in the bucket 24 and loaded with beverage containers 23. This is possible because when the bucket handle 84 is in the upright raised position 92, as shown in FIG. 9, there is a gap space, designated G in FIG. 9, of between about one and one-half (1.5) inches to about two (2.0) inches between the handle 36 and the bucket handle 84. The gap space designated G provides clearance for the knuckles of the person (not shown) carrying the bucket 24 by the bucket handle 84, such that this person's knuckles do not contact the handle 36.

Figure 10:
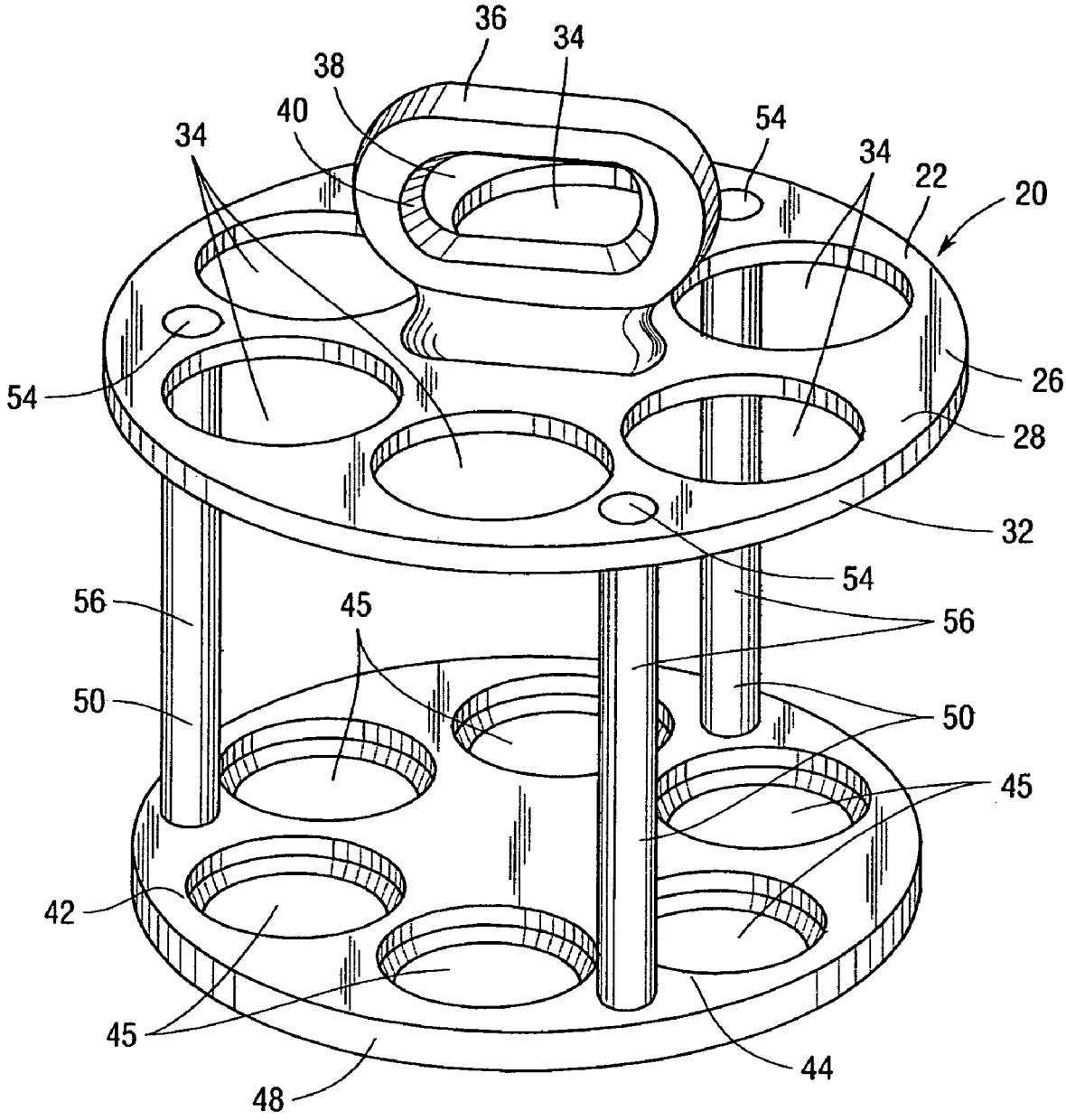
FIG. 10 is a perspective view of an insert having three connecting members wherein the second member is formed with recesses.
Figure 11:
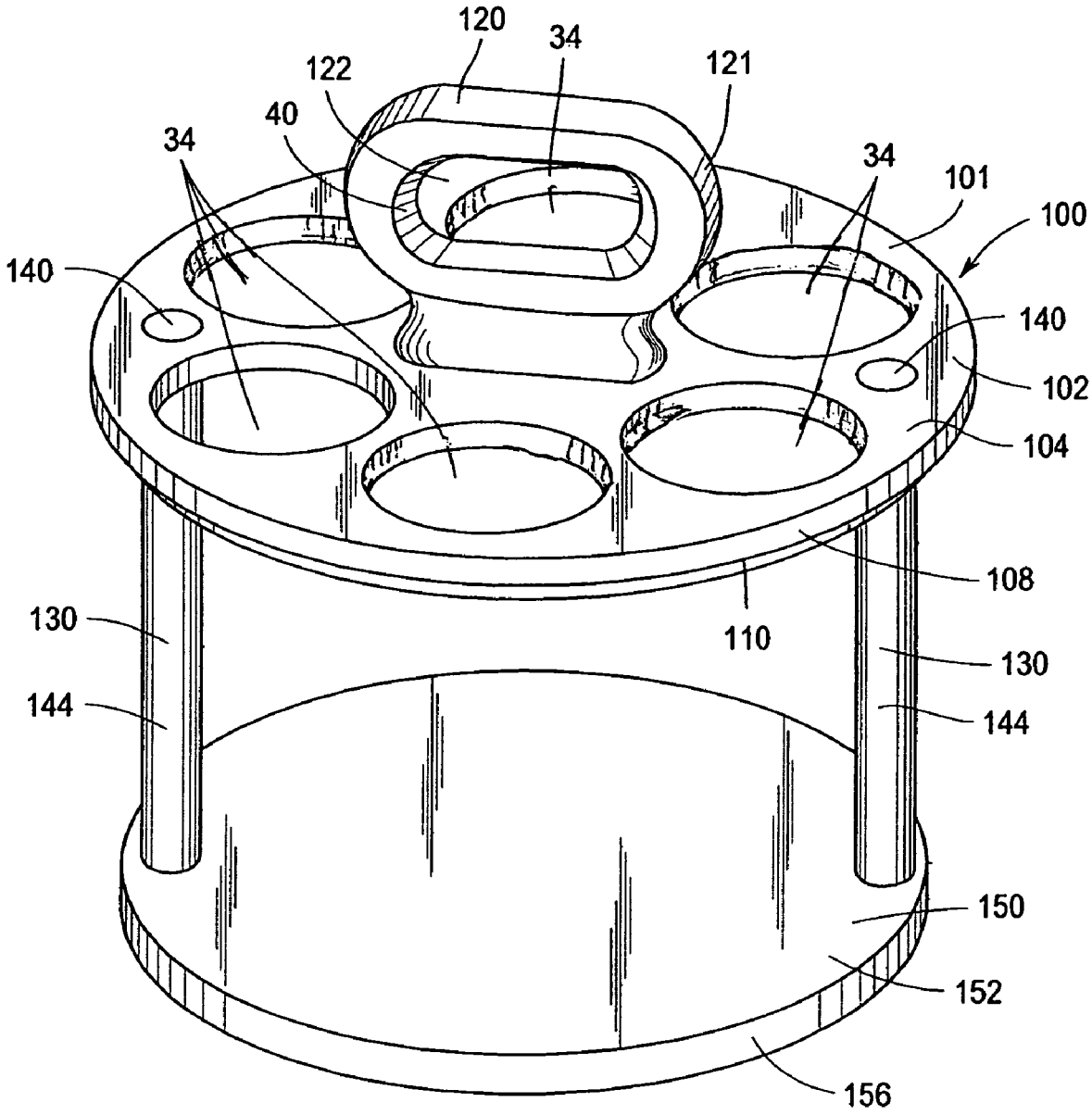
FIG. 11 is a perspective view of snap together embodiment of the insert.

As previously described, the insert can have fewer than four connectors 50, as shown in FIG. 10, which shows an embodiment having three connectors 50. In other preferred embodiments, there can be two connectors 50 or a single centrally located connector, or more than four connectors. FIG. 10 also shows the bottle side 44 of the second member has recesses 45. These recesses 45 vertically align with the bottle receiving openings 34. Accordingly, the bottoms of the bottles 23 are receivable in these recesses 45. This advantageously stabilizes the bottles 23. It is noted that any embodiment described herein, the second member can be embodied as being substantially planar or having recesses 45.

Turning now to FIGS. 11–17, shown therein is another preferred embodiment of a snap together insert 100. This embodiment is comprised of all blow molded components, which advantageously allows it to be mass produced at low production cost, and, as an advantage, this embodiment does not require any fasteners, glues, or adhesives to hold it together. In one of the preferred embodiments, a high density polyethylene (HDPE) is used to blow mold the components. In addition, the embodiment eliminates the need for the above described stops 96.

Figure 14A:
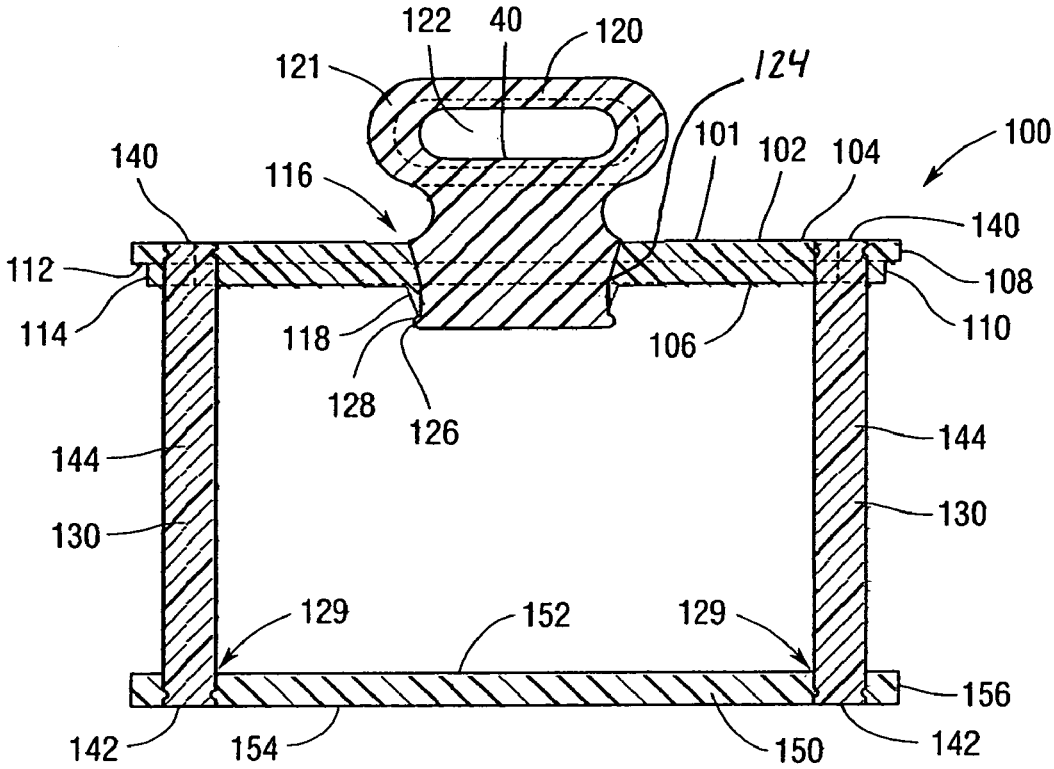
FIG. 14*a* is a sectional view of the snap together insert taken along cut line II—II of FIG. 12.
Figure 14B:
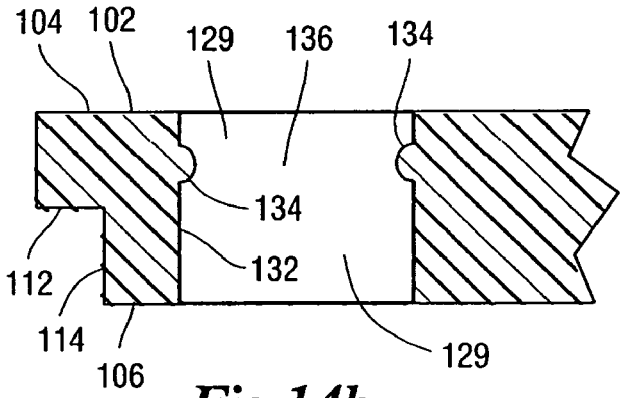
FIG. 14*b* is an enlarged sectional view of a portion of first member.
Figure 14C:
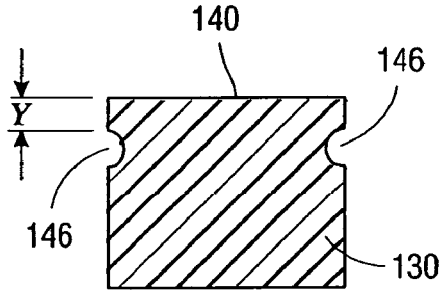
FIG. 14*c* is an enlarged sectional view of a portion of a connector member.
Figure 15:
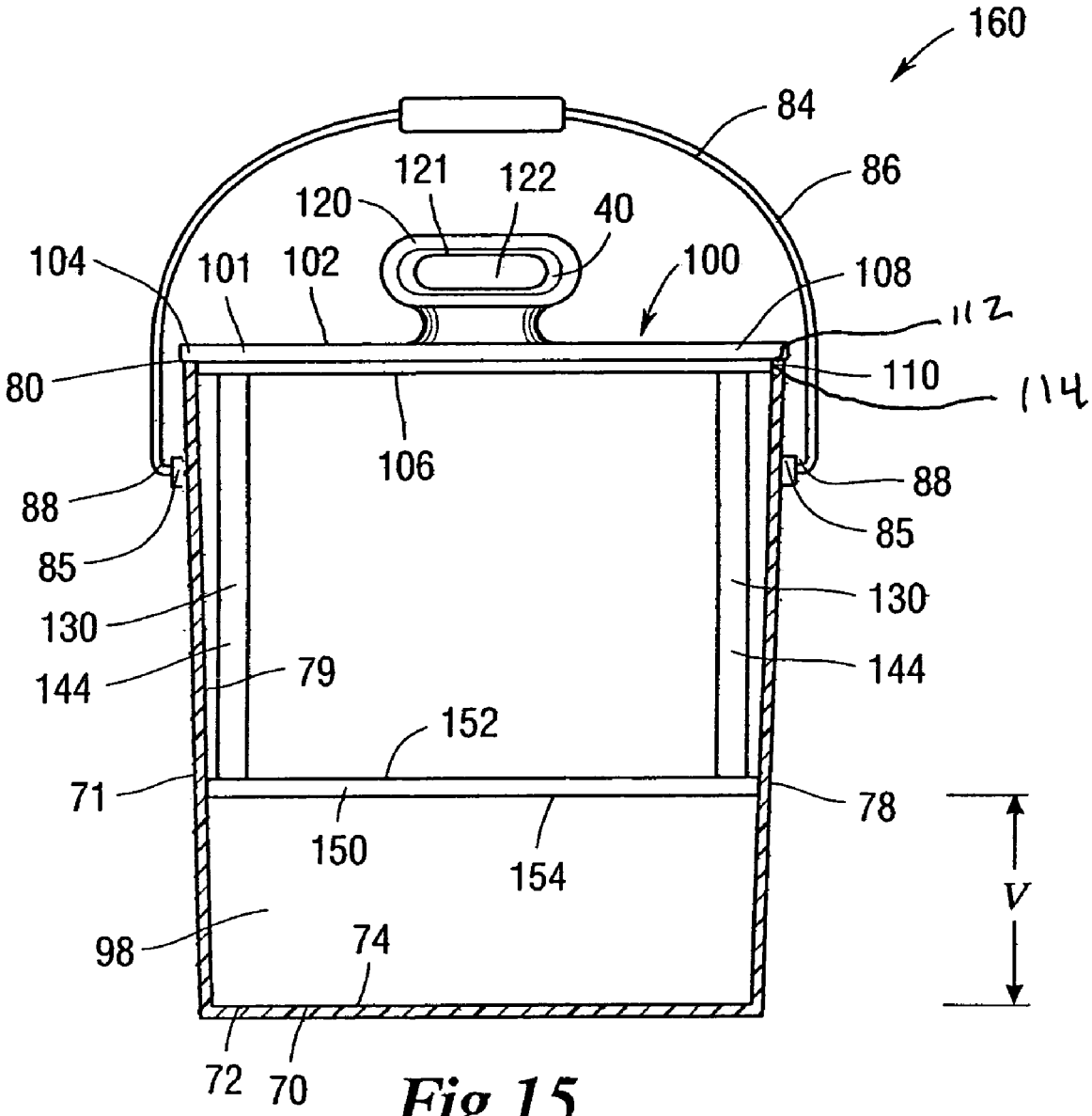
FIG. 15 is a sectional view of the snap together insert installed in a bucket.

FIGS. 11–17 generally show the snap together insert 100. As shown in FIGS. 11–14, the snap together insert that comprises a body 101 having a first member 102 that has a handle side 104, an opposed support side 106, and bottle receiving openings 34, with a surrounding surface 108 extending between the handle side 104 and support side 106. The surrounding surface 108 has a step 110 formed from a surrounding rim surface 112 that meets with a surrounding internal surface 114, best shown in FIG. 13. When the insert is positioned in the bucket 24, the rim surface 112 is supported on the rim 80 of the bucket 24, and the internal surface 114 faces the internal surface 79 of the bucket 24, as shown in FIG. 15.

As shown in FIGS. 14*a*–14*c*, the first member 102 also has a handle receiving opening 116 and the handle opening 116 (occupied by the hand 120 in FIG. 14*a*) extends from the handle side 104 to the support side 106. The handle opening 116 tapers in a direction toward the support side 106, as shown. There is a engagement wall 118 that extends a distance away from the support side 106 of the first member 102 and surrounds the handle opening 116. The handle 120 has a handle portion 121 having a handle opening 122. The handle 120 also has an insertion portion 124 and an engagement portion 126, as shown in FIG. 14*a*. The insertion portion 124 is tapered such that it can be received in the tapered handle opening 116. The handle 120 has a handle engagement portion 126 that extends from the handle insertion portion 124. The handle engagement portion 126 has a lip portion 128. The handle 120 can be advantageously manually inserted into the handle opening 116, and as the insertion progresses, the lip portion 128 of the handle engagement portion 126 forces on the engagement wall 118 and causes the engagement wall 118 to expand outwardly, until the lip portion 128 moves past the engagement wall 118. Once this happens, the engagement wall 118 snaps back into its pre-deformed state, and engages the lip portion 128 of the handle engagement portion 126, as shown in FIG. 14*a*. The handle 120 cannot thereafter be easily removed from the first member 102. Advantageously, no adhesives, fasteners, or other components are required to join the handle 120 and first member 102.

Figure 12:
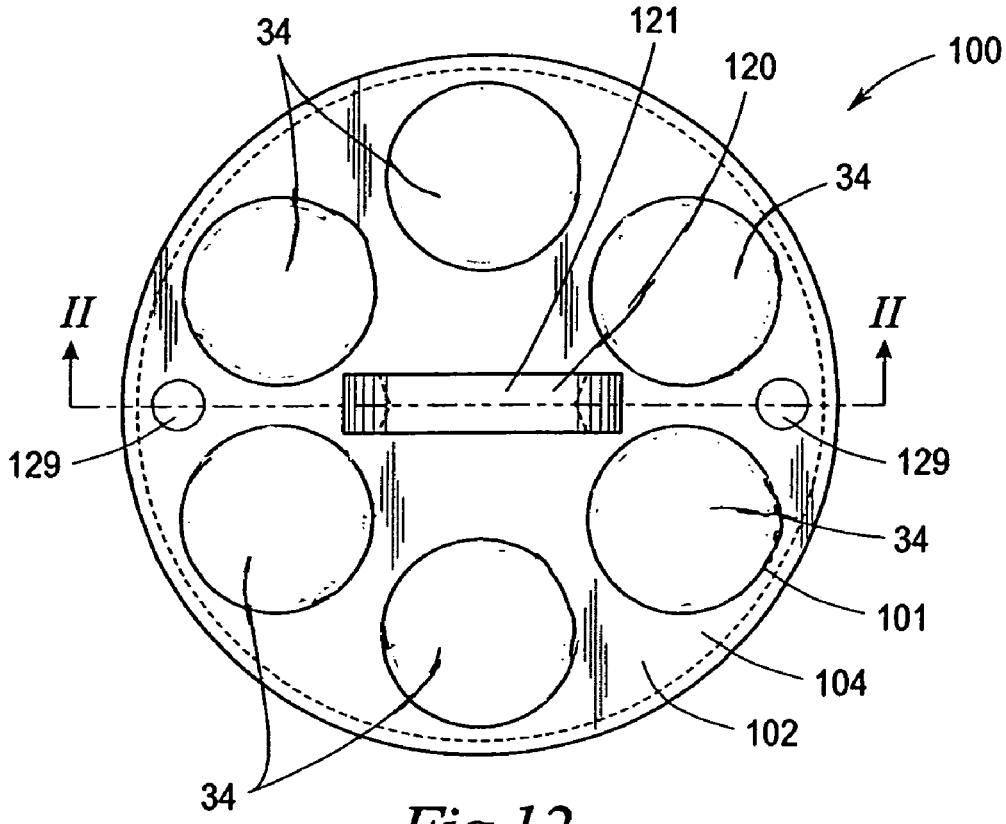
FIG. 12 is a top plan view of the snap together insert.
Figure 13:
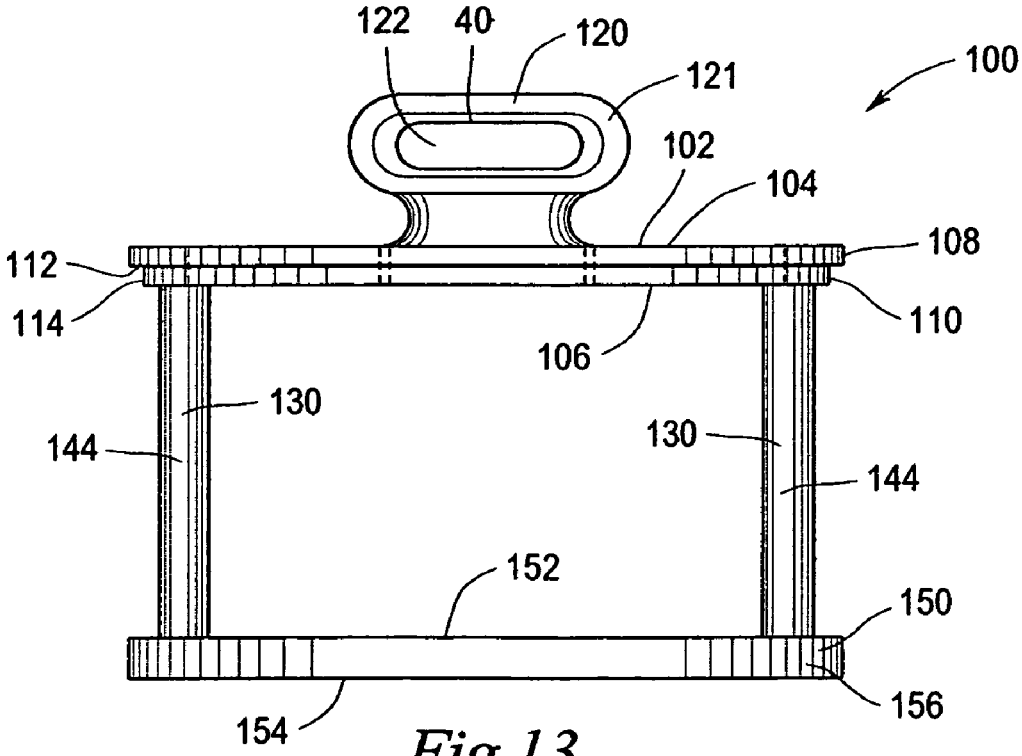
FIG. 13 is a side elevational view of the snap together insert.

As shown in FIG. 12, the first member 102 further has leg openings 129 for receiving connectors or legs 130. In one of the preferred embodiments, there are two connector openings 129, as shown, but it is to be understood that in other embodiments, there can be three connector openings 129 spaced equal distances from one another, or at least four such connector opening 129 spaced equal distances.

The connector openings 129 advantageously connect with a connector 130 without the need for adhesives, fasteners, nails, or other components. As shown in FIG. 14*b*, which is an enlarged sectional view of a portion of first member 102, connector opening 129 is defined by a surrounding wall 132 that has a protruding annular rib 134 formed in it, and the annular rib 134 defines a protruding annular rib opening 136. The diameter of the connector opening 129 is greater than the diameter of the protruding annular rib opening 136.

As shown in FIGS. 14*a* and 14*c*, the connector or leg 130 has a generally right cylindrical shape, and has opposed first and second ends 140, 142, respectively, with a central portion 144 extending between the first and second ends 140, 142, respectively. Each connector 130 has two-circumferential grooves 146. The grooves 146 are spaced a groove distance, designated Y in FIG. 14*c*, away from the first and second ends 140, 142, respectively.

As shown in FIGS. 11–13 and 14, the insert 100 has a second member 150 having a bottle side 152, a base side 154, and a surrounding surface 156 extending between the bottle side 152 and base side 154. The second member 150 has connector openings 129, as described above, with annular ribs 134, and in one of the preferred embodiments has two such connector openings 129.

To assemble the insert 100, the handle 120 is joined to the first member 102 in the above-described manner, that is, it is forceably pushed into the handle opening 116. Then the connectors 130 are moved into each of the connector openings 129 in the following manner. The first end 140 of one of the connectors 130 is aligned with the connector opening 129 in the support side 106 of the first member 102, and is forcibly pushed into the handle connector opening 129. This causes the annular rib 134 to engage the circumferential groove 146 in the connector 130, thus locking or joining the first member 102 and connector 130 together. The same process is repeated to join the remainder of the legs or connectors 130 to the first member 102. Then, the second ends 142 of the connectors 130 are aligned with the connector openings 129 in the second member 150. The second ends 142 are moved through the connector openings 129 in the bottle side 152 of the second member 150, until the connectors 130 and second member 150 snap together.

Figure 16:
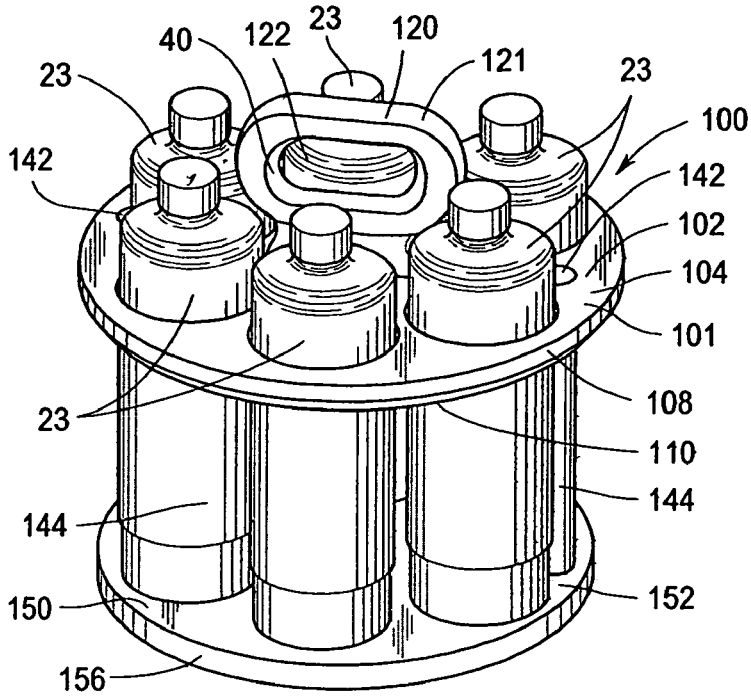
FIG. 16 is a perspective view of the snap together insert loaded with bottles.
Figure 17:
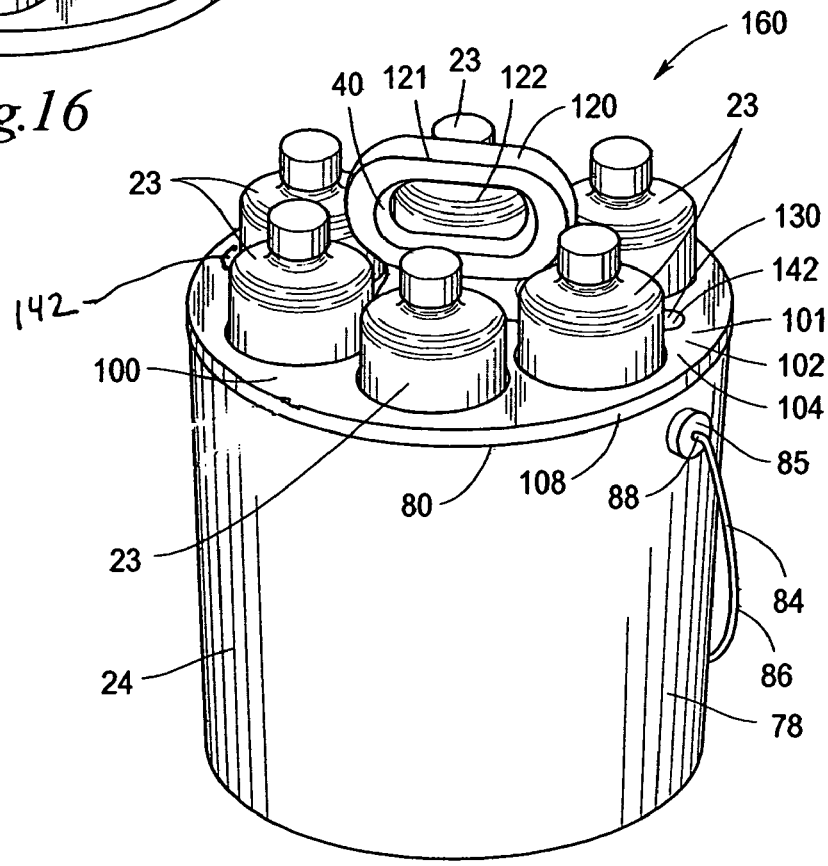
FIG. 17 is a perspective view of the snap together insert installed in a bucket.

As shown in FIGS. 15 and 17, the assembled insert 100 is then placed in a bucket 24 to form a carrier 160. The insert 100 can be loaded with bottles 23 before it is installed in the bucket 24, as shown in FIG. 16. As shown in FIGS. 15 and 17, the insert 100 is advantageously supported on the bucket rim 80, which eliminates the need for stops joined to the interior surface of the bucket. This is possible because the surrounding rim surface 112 contacts the bucket rim 80 and rests on the bucket rim 80, which prevents the insert 100 from sliding into the bucket 24. The surrounding internal surface 114 prevents the insert 100 from sliding once installed in the bucket 24. There is also a storage space or area 98 defined in the bucket 24 between the surrounding bucket wall 71, the bucket base 70, and the base side 154 of the insert 100. As described above in connection with the prior embodiments, items can be advantageously stored in the storage area 98. Also, the depth of the storage area, designated V in FIG. 15, can be varied by providing the connectors 130 with different lengths.

Therefore, as one of the advantages, the insert 100 can be readily manually snapped together and does not require any fasteners or adhesives. This is possible because the connectors 150, handle 120, and first and second members 102, 150, respectively, are all blow molded plastic, for example, high density polyethylene (HDPE) in one of the preferred embodiments. In addition, the insert can advantageously be mass produced at low production costs, is durable, is lightweight, and prevents the loss of personal articles.

It will be appreciated by those skilled in the art that while the bucket insert has been described above in connection with particular embodiments and examples, the bucket insert is not necessarily so limited that other embodiments, examples, uses, and modifications and departures from the embodiments, examples, and uses may be made without departing from the bucket insert.

What is claimed:

1. A removable insert for use in a bucket, the insert comprising:

a first member and a second member, at least one connector interconnecting the first member and the second member, the first member formed from polyethylene and having a beverage container opening and the first member having a handle side and an opposed support side and the first member having a handle opening and an engagement wall that surrounds the handle opening and the engagement wall extends from the handle side to the support side and tapers in a direction toward the support side and the engagement wall is movable between an unflexed position and a flexed position, and a handle having an insertion portion having a taper and an engagement portion having a lip portion such that when the handle engagement portion is manually moved into the handle opening the engagement wall of the first member moves outwardly from the unflexed position to the flexed position to accommodate the lip portion and wherein after the lip portion has moved past the engagement wall the engagement wall returns to the unflexed position and engages the lip portion to join the handle and the first member such that after introduction of the handle into the opening in the engagement wall the handle can be used to introduce and remove the insert from the bucket.

2. The insert of claim 1 wherein the first member the second member the at least one connector and the handle are each blow molded and comprise high density polyethylene.

3. The insert of claim 1 wherein the first member and second member have connector openings for receiving the at least one connector therein and each of the connector openings is defined by a surrounding interior wall having an annular rib.

4. The insert of claim 3 wherein the at least one connector has opposed first and second ends a circumferential grooves spaced a distance away from the opposed first and second ends such that when the connector is moved through the connector openings in the first and second members the annular ribs become locking received in the circumferential grooves.

5. The insert of claim 1 wherein the first member has a surrounding surface that extends between the handle side and the support side and the surrounding surface has a step including a surrounding rim surface that meets with a surrounding internal surface and the surrounding rim surface is adapted to be positioned on the bucket and the surrounding internal surface is adapted to abut against the bucket such that the first member is prevented from sliding off the bucket after having been introduced into the bucket.

6. A carrier comprising:

an insert having a first member and a second member, at least one connector interconnecting the first and the second members, the first member having a beverage container opening, and the first member having a handle side and an opposed support side and the first member having a handle opening and an engagement wall that surrounds the handle opening and the engagement wall extends from the handle side to the support side and tapers in a direction towards the support side and the engagement wall is movable between an unflexed position and a flexed position, a handle having an insertion portion having a taper and an engagement portion having a lip portion such that when the handle engagement portion is moved into the handle opening the engagement wall of the first member flexes outwardly from the unflexed position to the flexed position to accommodate the lip portion and wherein after the lip portion has moved past the engagement wall the engagement wall returns to the unflexed position and engages the lip portion to join the handle and the first member and the handle extends from the handle side of the first member, a bucket having a rim that meets with a surrounding bucket wall that extends to and is joined with a base and the bucket having an interior surface, a step formed in the first member, the step having a rim surface and a step internal surface and the insert is adapted to be positioned on the rim of the bucket such that when the insert is positioned in the bucket the rim surface of the insert is supported on the rim of the bucket and the step internal surface faces the interior surface of the bucket, a storage area defined between the base of the bucket and the second member when the insert is supported on the rim of the bucket, and a bucket handle pivotally connected to the bucket such that the bucket can be carried by the bucket handle when the insert is positioned in the bucket.

7. The insert of claim 6 wherein the first member and second member have connector openings for receiving the connector therein and the connector opening is defined by a surrounding interior wall having an annular rib and wherein the first member the second member the at least one connector and the handle are each blow molded.

8. The insert of claim 7 wherein the at least one connector has opposed ends and circumferential grooves spaced a distance from the opposed ends such that when the connector is moved through the connector openings in the first and second members the annular ribs become locking received in the circumferential grooves.

9. The insert of claim 6 wherein the storage area has a depth and the at least one connector can be selected from connectors having predetermined lengths so that the volume of the storage area can be adjusted depending on the length of the at least one connector.

10. A method of making a carrier comprising:

providing a bucket insert having a first member and a second member, providing the first member with a handle side and an opposed support side and forming a handle opening in the first member and providing an engagement wall that surrounds the handle opening and extending the engagement wall from the handle side to the support side and tapering the engagement wall in a direction toward the support side and wherein the engagement wall is movable between an unflexed position and a flexed position, providing at least one connector for interconnecting the first and the second members and providing the first member and the second member with connector openings for receiving the at least one connector therein and the connector openings are defined by a surrounding interior wall having an annular rib and providing the at least one connector with opposed ends and circumferential grooves and spacing the circumferential grooves a distance from the opposed ends and moving the at least one connector through the connector openings in the first and second members such that the annular ribs become lockingly received in the circumferential grooves joining the first member and the second member, providing the first member with a beverage container opening for receiving a beverage container, providing a handle having an insertion portion having a taper and an engagement portion having a lip portion such upon moving the handle engagement portion into the handle opening the engagement wall of the first member moves outwardly from the unflexed position to the flexed position to accommodate the lip portion and wherein after moving the lip portion past the engagement wall the engagement wall returns to the unflexed position joining the handle and the first member and wherein the first member the second member the at least one connector and the handle are each blow molded, providing a bucket having a rim and an interior surface, and forming a step in the first member having a rim surface and a step internal surface and positioning the bucket insert in the bucket such that the rim surface is supported on the rim of the bucket and the step internal surface faces an interior surface of the bucket.

* * * * *